United States Patent [19]

Viesturs

[11] Patent Number: 4,785,486

[45] Date of Patent: Nov. 22, 1988

[54] COLLAPSIBLE BATHTUB

[75] Inventor: Eric A. Viesturs, Southbury, Conn.

[73] Assignee: Connecticut Artcraft Corp., Naugatuck, Conn.

[21] Appl. No.: 678,106

[22] Filed: Dec. 4, 1984

[51] Int. Cl.[4] ..... A47K 3/06

[52] U.S. Cl. ..... 4/585; 4/593; 4/587

[58] Field of Search ..... 4/584–587, 4/592–593, 506, 513

[56] References Cited

U.S. PATENT DOCUMENTS

| | | | |
|---|---|---|---|
| 2,841,798 | 7/1958 | Kennedy | 4/587 |
| 2,950,484 | 8/1960 | Jaffe | 4/587 |
| 3,334,360 | 8/1967 | Hoxeng et al. | 4/585 |
| 4,017,915 | 4/1977 | Prewitt | 4/585 |
| 4,305,165 | 12/1981 | Wall, Jr. | 4/585 |
| 4,434,517 | 3/1984 | Dorris | 4/585 |
| 4,485,502 | 12/1984 | Marcanio | 4/587 |

FOREIGN PATENT DOCUMENTS

| | | | |
|---|---|---|---|
| 0389447 | 6/1908 | France | 4/585 |
| 0008205 | of 1902 | United Kingdom | 4/585 |

*Primary Examiner*—Henry J. Recla
*Assistant Examiner*—Linda J. Sholl

[57] ABSTRACT

A collapsible bathtub adapted for placement on top of a mattress employs a horizontal flexible plastic rectangular sheet having two opposite sides and two opposite ends. First and second flexible plastic parallel side walls are integral with the sheet, each side wall having a collapsed position at which it is essentially coplanar with the sheet, each side wall having an erect position at which it extends vertically upwards from a corresponding one of the two sides of the sheet; First and second flexible plastic end walls disposed at right angles to said side walls are integral with said sheet. Each end of each end wall is secured to a corresponding end of a corresponding side wall, each end wall having a collapsed position at which it is essentially coplanar with said sheet and having an erect position at which it extends vertically upwards from a corresponding one of the two ends of the sheet; First and second sockets are secured to the first end wall, each of the first and second sockets being disposed adjacent a corresponding one of the side walls; Third and fourth sockets are secured to the second end wall, each of the third and fourth sockets being disposed adjacent a corresponding one of the side walls; a first elongated socket engaging member is detachably secured to said first side wall and, when all walls are in erect positions, extends between and engages the first and third sockets; a second elongated socket engaging member is detachably secured to said second side wall and, when all walls are in erect positions, extends between and engages the second and fourth sockets.

4 Claims, 2 Drawing Sheets

COLLAPSIBLE BATHTUB

BACKGROUND OF THE INVENTION

It is often necessary to bathe invalids and other bedridden individuals while they remain in bed. This is a difficult and time consuming task for one or more attendants.

The present invention simplifies this task as well as making it easier by using a collapsible bathtub which when not in use remains in place on the bed and which is easily erected on the bed with the individual to be bathed in place in the bathtub as it is erected. The tub can be filled with water and the patient bathed. Thereafter the water can be removed and the bathtub collapsed without removing the individual from the bed.

SUMMARY OF THE INVENTION

A collapsible bathtub in accordance with the principles of the invention is adapted to be placed on top of a bed. The bathtub itself comprises a horizontal flexible plastic rectangular sheet having two opposite sides and two opposite ends. First and second flexible plastic parallel side walls are integral with the sheet. Each side wall has a collapsed position at which it is essentially coplanar with the sheet, each side wall having an erect position at which it extends vertically upwards from a corresponding one of the two sides of the sheet.

First and second flexible plastic end walls disposed at right angles to said side walls are also integral with said sheet, each end of each end wall being secured to a corresponding end of a corresponding side wall. Each end wall has a collapsed position at which it is essentially coplanar with said sheet and having an erect position at which it extends vertically upwards from a corresponding one of two ends of the sheet.

First and second socket means are secured to the first end wall, each of the first and second socket means being disposed adjacent a corresponding one of the side walls. Third and fourth socket means are secured to the second end wall, each of the third and fourth socket means being disposed adjacent a corresponding one of the side walls.

First elongated socket engaging means is detachably secured to said first side wall and, when all walls are in erect positions, extends between and engaged the first and third socket means; Second elongated socket engaging means is detachably secured to said second side wall and, when all walls are in erect positions extends between and engages the second and fourth socket means.

In use, the bathtub in collapsed position is disposed on a bed as a sheet and the patient then lies on top of the sheet. The bathtub is then erected manually on the bed while the patient remains on the bed when the patient is to be bathed. Water is then poured either by pail or hose into the bathtub. After the patient is bathed, the water is either drained off via a drain or is otherwise removed and the bathtub is manually collapsed without moving the patient from the bed and then remains on the bed for subsequent use.

DETAILED DESCRIPTION OF PREFERRED EMBODIMENT

Figures 1, 2, 3:
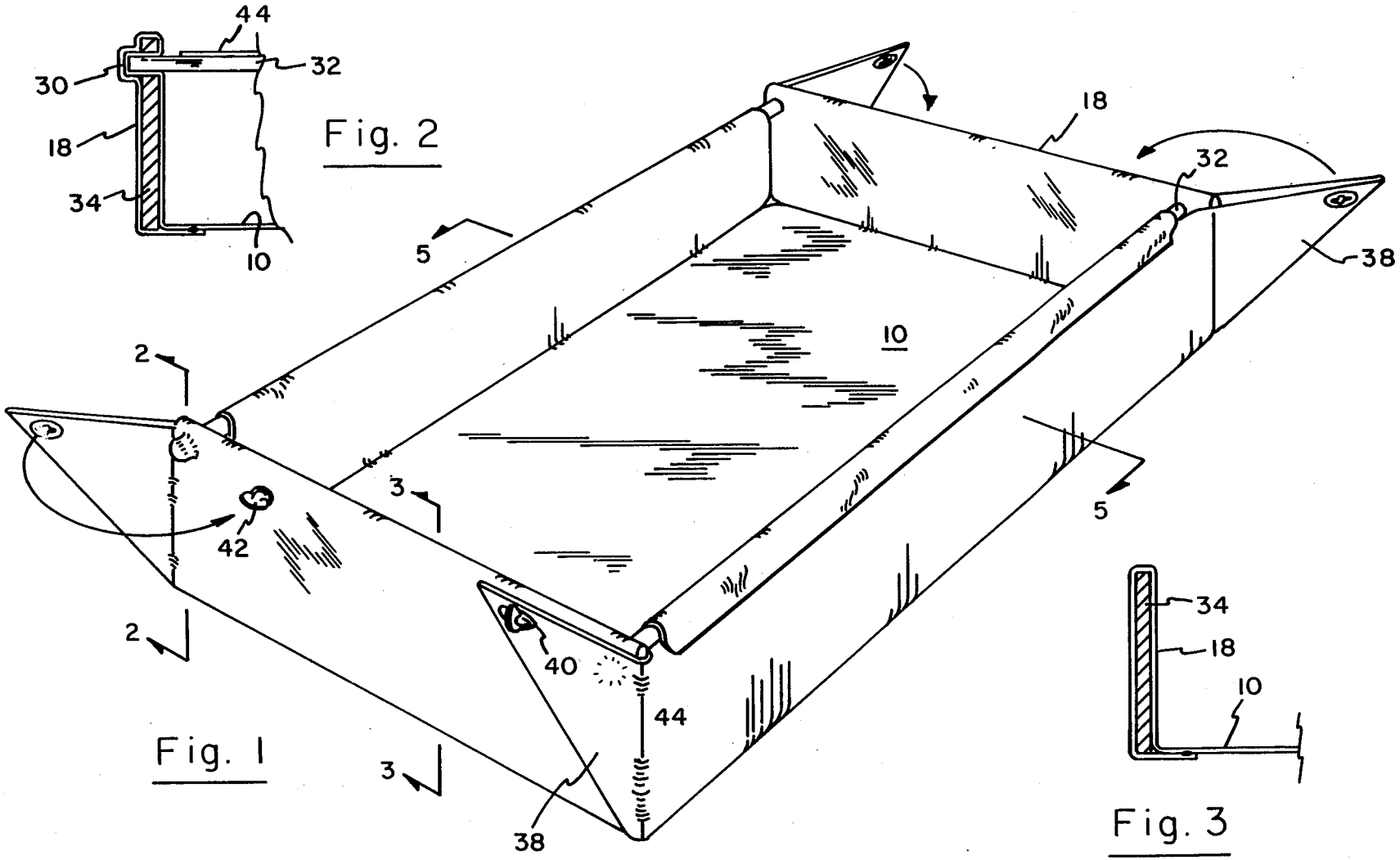
FIG. 1 is a perspective view of one embodiment of the invention in erect position.
FIG. 2 is a view taken along line 2—2 in FIG. 1.
FIG. 3 is a view taken along line 3—3 in FIG. 1.
Figure 4B:
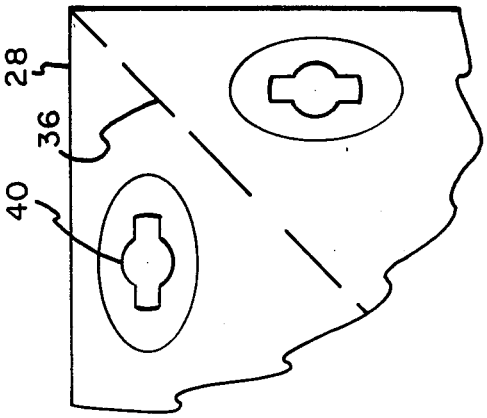
FIG. 4 is a plan view of the embodiment of FIG. 1 shown in collapsed position.
Figure 4A:
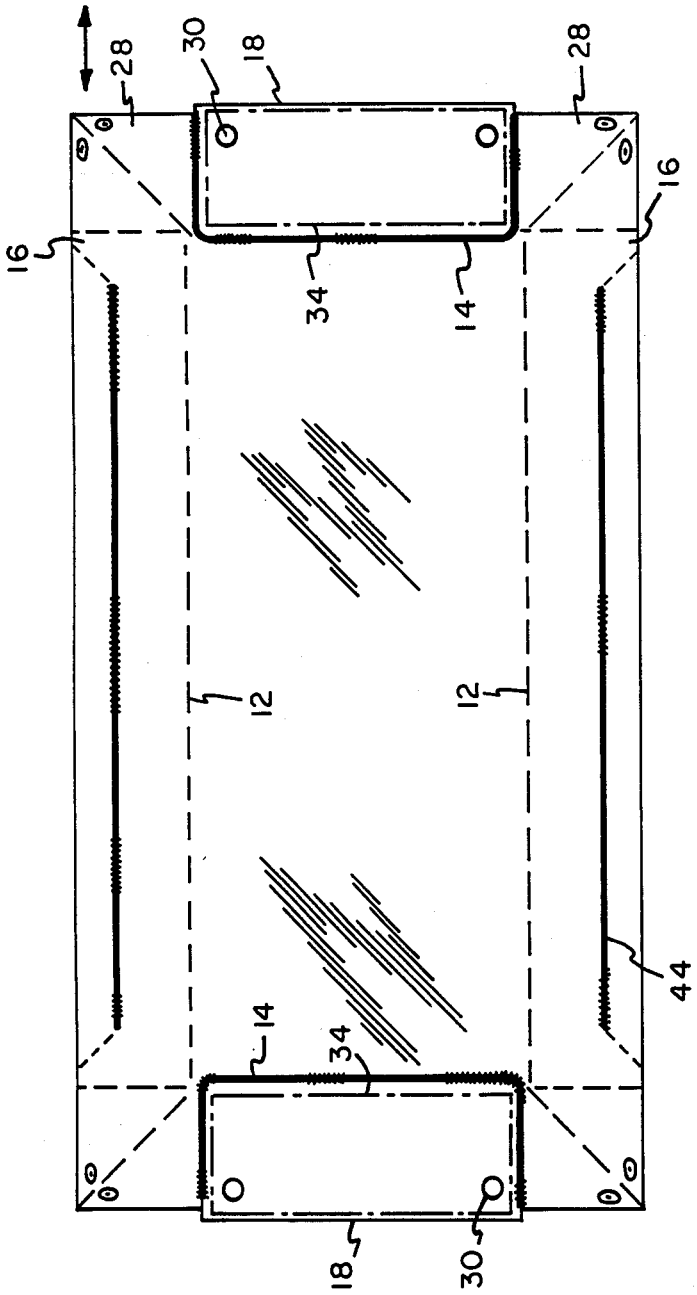
Figure 5:
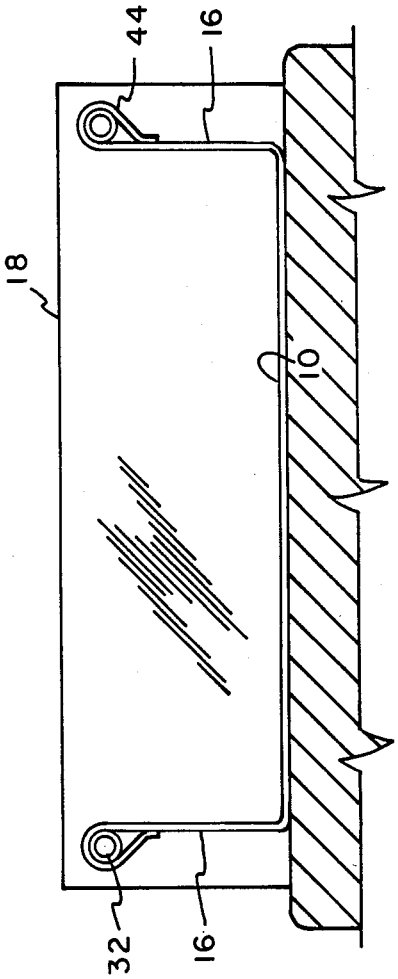
FIG. 5 is a view taken along line 5—5 in FIG. 1.

Referring now to FIGS. 1-5 a horizontal flexible plastic rectangular sheet 10 has two opposite sides 12 and two opposite ends 14. First and second flexible plastic parallel side walls 16 are integral with the sheet. Each side wall has a collapsed position at which it is essentially coplanar with the sheet, each side wall having an erect position at which it extends vertically upwards from a corresponding one of the two sides of the sheet.

First and second flexible plastic end walls 18 disposed at right angles to said side walls are integral with said sheet. Each end of each end wall is secured to a corresponding end of a corresponding side wall via a rectangular portion 28 of the sheet. Each end wall has a collapsed position at which it is essentially coplanar with said sheet and has an erect position at which it extends vertically upwards from a corresponding one of the two ends of the sheet. First and second sockets 30 are secured to the first end wall, each of the first and second sockets being disposed adjacent a corresponding one of the side walls. Similarly third and fourth sockets 30 are secured to the second end wall, each of the third and fourth sockets being disposed adjacent a corresponding one of the side walls. A first elongated socket engaging member 32 is detachably secured to said first side wall and, when all walls are in erect positions, extends between and engaging the first and third sockets. A second elongated socket engaging member 32 is detachably secured to said second side wall and, when all walls are in erect positions extends between and engaging the second and fourth sockets:

Each end wall is hollow and contains a flat thin rectangular support (stiffening) member 34 through which the sockets extend and are secured thereto.

Each portion 28 can be folded upon itself along diagonal line 36 to produce a vertical flap 38 which is disposed along the outer surfaced of the corresponding end wall adjacent the corresponding end when the walls are in vertical erect position. Each portion 28 contains two button hole like members 40 which are aligned when the flap is formed. Corresponding manually operable catches 42 are disposed in the end walls and are alignable with the eyes to manually lock the flaps in place when the bathtub is erect or to manually unlock the flaps to enable the bathtub to be collapsed.

The top horizontal edge of each side wall is rolled upon itself and sealed to form a hollow elongated conduit 44 open at both ends. Each member 32 can be a hollow bar or if desired can be formed of several telescopically interconnectable detachable bar sections.

The bathtub can be constructed entirely of plastic. Alternatively, the sockets, bars and members 34 as well as the members 40 and catches 42 can be formed out of aluminum or other light metal which will not rust or corrode or contaminate water when in use.

For extra long and or wide bathtubs, it may be sometimes necessary to use conduits and bars at the bottom as well as the top of each side wall, adding additional sockets as necessary to the end walls. The side walls can also be hollow and contain support members.

Drain and/or inlet connections for water discharge and feed can be mounted in conventional manner in the bathtub structure.

What is claimed is:

1. A collapsible bathtub adapted for placement on top of a mattress and comprising:

a horizontal flexible plastic rectangular sheet having two opposite sides and two opposite ends;

first and second flexible plastic parallel side walls, each side wall being integral with the sheet and having a collapsed position at which it is essentially coplanar with the sheet, each side wall having an erect position at which it extends vertically upwards from a corresponding one of the two sides of the sheet, each side wall having an elongated top disposed horizontal conduit open at both ends which extends between both end walls;

first and second flexible plastic end walls disposed at right angles to said side walls and being integral with said sheet, each end of each end wall being secured to a corresponding end of a corresponding side wall, each end wall having a collapsed position at which it is essentially coplanar with said sheet and having an erect position at which it extends vertically upwards from a corresponding one of the two ends of the sheet, each end of each end wall being secured to the adjacent end of the adjacent side wall by a portion of the sheet which is flat and horizontal when the walls are in collapsed position and which is folded upon itself to form a vertical flap when all walls are in erect position whereby four flaps are formed;

first and second elongated members, each member being removably disposed in a corresponding one of said conduits, and, when all walls are in vertical position, extending between the two end walls, each elongated member having one end adjacent one end wall and having an opposite end adjacent the other end wall; and first, second, third and fourth sockets, each of the first and second sockets being secured to the first end wall and adapted to detachably engage a corresponding one of the adjacent one ends of the corresponding elongated member when all walls are in vertical position, each of the third and fourth sockets being secured to the second end wall and adapted to detachably engage a corresponding one of the adjacent said other end of the corresponding elongated member when all walls are in vertical position, all of said sockets and said elongated members cooperating when engaged to hold said walls in vertical position.

2. The bathtub of claim 1 wherein each flap engages the outer surface of the corresponding end wall adjacent the corresponding end of the corresponding end wall.

3. The bathtub of claim 2 further including means to detachably secure each flap to the corresponding outer surface of the corresponding end wall.

4. The bathtub of claim 3 wherein each end wall has a hollow chamber, each end wall having a flat stiffening support member disposed in the chamber of the end wall.

* * * * *